US005402695A

United States Patent [19]

Hornung

[11] Patent Number: 5,402,695

[45] Date of Patent: Apr. 4, 1995

[54] FEEDING DEVICE FOR AN INSERTING TOOL FOR SUPPLYING FASTENERS, PARTICULARLY SCREWS

[75] Inventor: Ewald Hornung, Rinteln, Germany

[73] Assignee: Helfer & Co. KG, Weideweg, Germany

[21] Appl. No.: 70,676

[22] Filed: Jun. 2, 1993

[30] Foreign Application Priority Data

Jun. 11, 1992 [DE] Germany ..... 42 19 095.9

[51] Int. Cl.[6] ..... B25B 23/06

[52] U.S. Cl. ..... 81/434; 81/435; 227/120; 227/135

[58] Field of Search ..... 81/434, 435, 57.37; 227/120, 123, 135

[56] References Cited

U.S. PATENT DOCUMENTS 4,404,877 9/1983 Mizuno et al. .
5,083,483 1/1992 Takagi .

FOREIGN PATENT DOCUMENTS 0058986 1/1982 European Pat. Off. .
2364742 4/1978 France .
2541046 3/1977 Germany .
9207847 6/1992 Germany .

*Primary Examiner*—James G. Smith
*Attorney, Agent, or Firm*—Merchant, Gould, Smith, Edell, Welter & Schmidt

[57] ABSTRACT

A feeding device for a fastener inserting tool, particularly screw. The structure of the feeding device is a two-armed rocking lever mounted on a slide element. This mounts the sprocket wheel for rotation about the same pin as the rocking lever. The connection between the rocking lever and sprocket wheel is by means of a ratchet detent.

6 Claims, 5 Drawing Sheets

FEEDING DEVICE FOR AN INSERTING TOOL FOR SUPPLYING FASTENERS, PARTICULARLY SCREWS

BACKGROUND OF THE INVENTION

The invention relates to a feeding device according to the introductory part of claim 1.

Feeding mechanisms for supplying fasteners to inserting tools, like screwdrivers, are known in a great variety of types. They generally work with a stepping mechanism, by which fasteners, arranged at fixed intervals on a feed strip, are advanced into a position in which they are aligned with the tool and thus can be driven into the workpiece.

From U.S. Pat. No. 4,404,877 a power-driven screwdriver with a feeding device is known. The stepping mechanism here consists of an indexing lever, that is pivoted on a fulcrum. The pivoting of the indexing lever is governed by a pin, that is located at its after extremity, and is guided by a cam slot. The forward end of the lever carries, mounted pivotally, a feeding finger, that is under the bias of a spring. This feeding finger grips, during the swing of the lever, behind the next screw on the feed-strip, and advances this during the backswing of the lever to a position in front of a screw hole. The briefly described feeding mechanism contains all-together a number of interworking parts. It is thus costly to manufacture and is subject to breakdown.

Patent DE-PS 25 41 046 discloses a feeding device with a stepping mechanism in the form of a sprocket wheel, the teeth of which engage perforations in the margin of the feed strip. This sprocket wheel can be connected via a ratchet clutch with a stepping wheel. For this purpose there are recesses in both sprocket disks of the sprocket-wheel, and the mid-points of these recesses are arranged around the circumference of a circle. In the engaged position the projections, mounted on the stepping wheel, engage in these recesses. The stepping wheel is at this point subjected to the bias of a spring, which with the return motion of the slide element to starting position allows a temporary release of the connection.

U.S. Pat. No. 5,083,483 shows a feeding device for an inserting machine that is similar to the above-mentioned DE-PS 25 41 046, whereby a rocking lever is mounted on the slide element, and the sprocket wheel is pivotally mounted at the end of the rocking lever that is applied to the feed strip. The rotating action is achieved indirectly, through a ratchet wheel, which works in mesh with the sprocket wheel. At the other end of the lever a guide-pin is provided, which is movably mounted in a cam slot. Through the movement of the guide-pin as a result of an obliquely disposed portion of the cam slot, the ratchet wheel is moved downwards by the rocking lever and turns in a clockwise direction. The sprocket wheel, which is meshed with the ratchet wheel, is in this way rotated, so that the feed strip is made to advance by one lock-step.

Because of the ratchet coupling assembly, these known mechanisms are unduly costly to construct, and are also unavoidably prone to breakdown. In addition, the preparation of the feed strip must be very precise, since with these machines several teeth on the perimeter of the sprocket wheel are constantly meshed with the perforations in the feed strip. Finally, the radius of the feed strip in the contact zone of the sprocket wheel is relatively small, so that the strip is unduly stretched with the result that the interval between the successive perforations in the feed strip can vary in size. This failing also leads to interruptions in the operation of the machine.

SUMMARY OF THE INVENTION

This is the point of departure for the idea behind the invention. The object of the invention is to simplify the known mechanism in such as way that it consists of a minimum of individual parts, and thus can be made both economical and reliable.

This object is achieved according to the invention, by having the rocking lever designed with two arms, and providing a stop, which stops the sprocket wheel during the moving of the feed strip into the inserting position for the screw.

The essential advantage of the invention over the current state of the art lies foremost in the avoidance of a control wheel with ratchet coupling, and this is highly advantageous from both an economic and an operational viewpoint. A cursory glance at the illustrations shows that simplification has been carried to the limit. Thus the number of parts subject to wear is reduced to a minimum, so that the useful life of the machine is correspondingly increased. Reducing the parts of the tool to a minimum is also very advantageous in terms of its overall weight.

A further advantage is the relatively large radius of the feed strip in the contact zone of the sprocket wheel. This radius corresponds to the interval between the cross-pin and the tooth of the sprocket wheel that is next to the feed strip. In this way the feed strip undergoes less stress while it is being moved than is the case with previous devices, so that a constant interval between the successive perforations in the feed strip is assured.

In addition, the unique motion of the sprocket wheel as it rotates around its spindle produces a constant penetration depth of the teeth in the perforations of the feed strip.

These are the decisive advantages of the invention over the current state of the art.

According to a further characteristic of the invention, the sprocket wheel consists of two sprocket disks mounted at a distance from each other, and connected to each other by a spindle.

A stopping block is appropriately located in the slide element, which during the engaging of the margin perforations of the feed strip prevents any backward movement of the latter.

Further characteristics of the feeding mechanism are described in the sub-claims.

BRIEF DESCRIPTION OF THE DRAWINGS

The invention is further explained in the following example of its application. The accompanying illustration shows, in diagram form.

DETAILED DESCRIPTION OF THE PREFERRED EMBODIMENT

The inserting tool is indicated by the numeral 1, and for the sake of clarity is only partially presented; it is shown by way of example with a drive-shaft powered by an electric motor, that is connectable to the screwdriver 2 using a releasable coupling (also not further shown), e.g. a claw clutch or similar. The screwdriver 2 is arranged in a box-type elongate guide frame.

Figure 1:
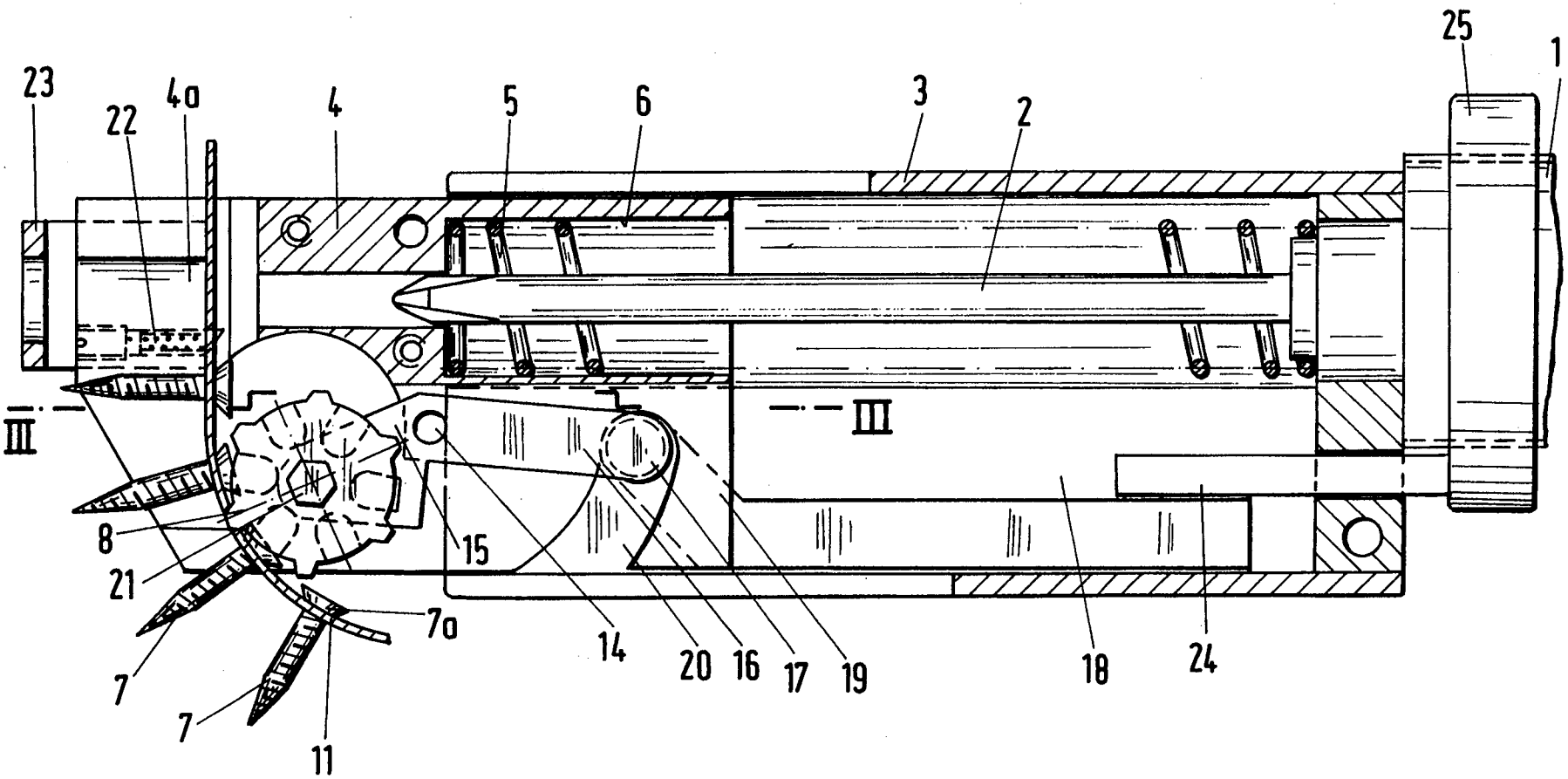
FIG. 1 a vertical cross-section of the inserting tool with feed strip set according to the invention in a position prior to the insertion procedure.
Figure 8:
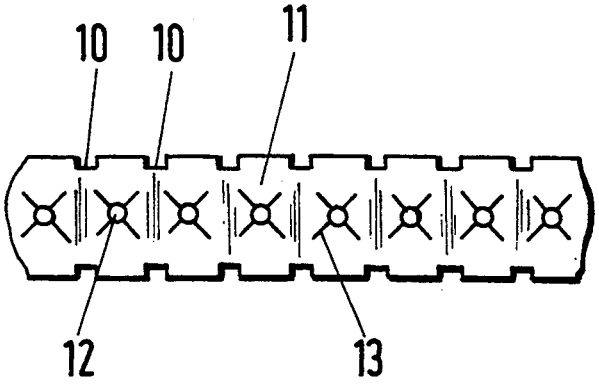
FIG. 8 a partial top view of the feed strip without its screw load.

In the guide frame there is mounted in addition a slide element 4, that slides lengthwise within it, which is under the bias of one or more springs 5, that mesh with corresponding recesses 6 in the slide element 4 and are biased, as in FIG. 1 of the illustration, so as to move it to the left. In the slide element 4 a stepping mechanism is mounted for the step-by-step movement of the screws 7 into the screwing position. This stepping mechanism is designed as a sprocket wheel with two sprocket disks 8,9 and is pivotally mounted in the slide element. The teeth 8*a*, 9*a* interlock with the margin perforations 10 in a feed strip 11 (FIG. 8), in rather the same way as the film advancer in a camera works. In the feed strip 11 are flanges 13 arranged around an opening 12, which grip the heads 7*a* of the screws 7 installed in the feed strip 11. The feed strip 11 consists preferably of an elastic synthetic material.

In the area of the forward end of the slide element 4 is an aperture 4*a*, in which the screw 7 comes to rest before the screwing operation.

In the slide element 4 is mounted a two-armed lever that pivots around a cross pin 14; on the arm 15 that is applied to the feed strip 11 the sprocket wheel is pivotally mounted, and on the other arm 16 a control pin 17 is mounted, that runs in a cam slot. This cam slot is cut out of a plate 18, which is arranged in the guide frame 3, and affixed to it. The control pin 17 represents the operating control element for a stepping mechanism.

Figure 9:
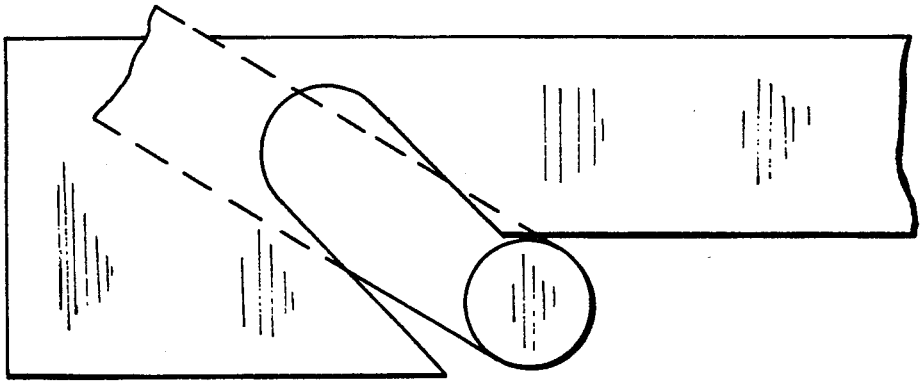
FIGS. 9 and 10 Partial view of the plate with the two cam slot sections, whereby the guide pin is shown in the screwing position and out of the screwing position.
Figure 10:
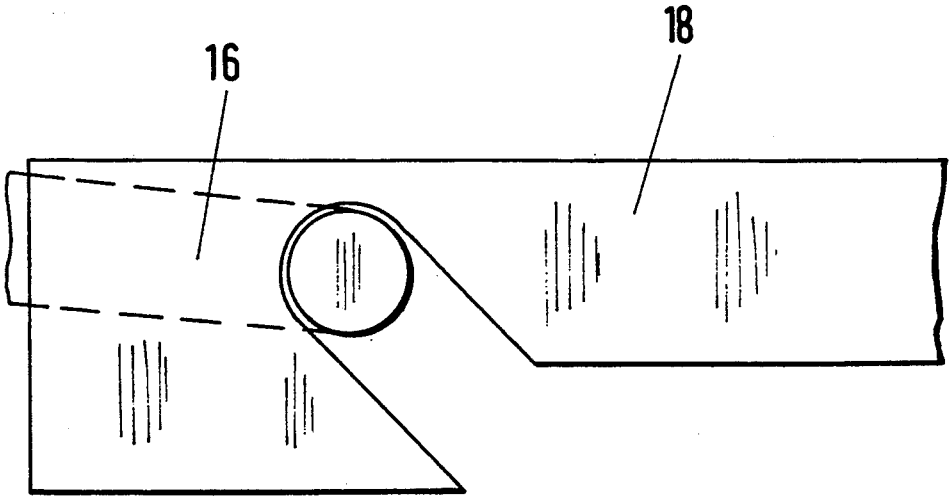

As is shown in FIGS. 9 and 10, the cam slot begins with a section 19 that runs obliquely to the lengthwise direction of the guide frame, and then turns into a longitudinal recess on the underside of the plate 18.

So that the guide pin 17 can reach the cam slot in the plate 18, there is an opening 20 in the sidewall of the slide element 4, which allows free movement of the guide pin 17 during swivelling of the two-armed lever.

The two sprocket disks 8, 9 are connected with each other via a spindle 21, which is carried by a pivot on the arm 15 of the rocking lever.

Figure 7:
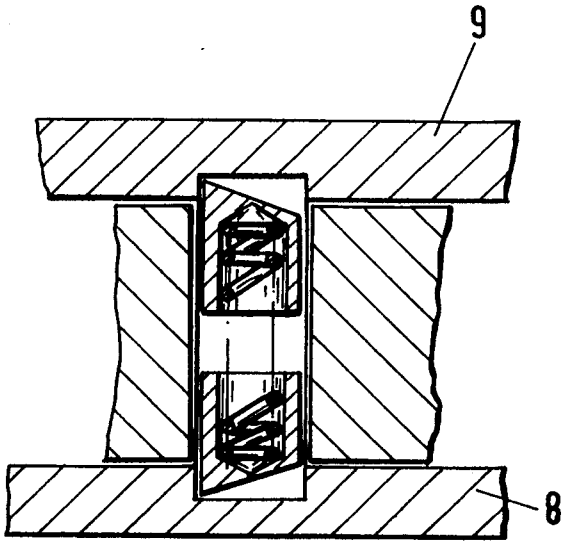
FIG. 7 shows an enlarged view of FIG. 6 in the same cross-section.
Figure 4:
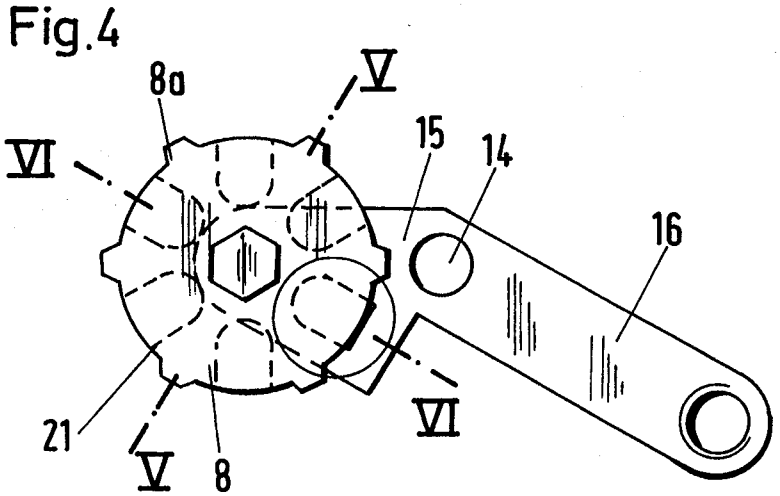
FIG. 4 a partial view of the layout according to FIGS. 2 and 3.
Figure 6:
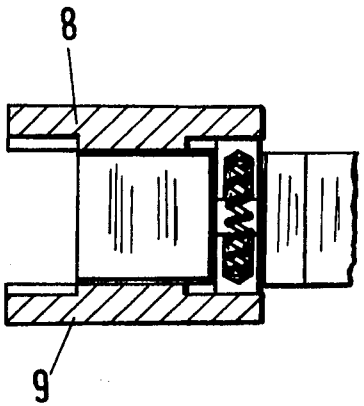
FIG. 6 is a cross-sectional view along the line VI—VI of FIG. 4 in the circled area of FIG. 4.

FIGS. 4, 6 and 7 show a locking mechanism 30 (or stop means) which locks the sprocket wheel 8, 9 in the insertion position of the screw 7. This locking mechanism 30 can take various forms. In the version as shown in FIGS. 6 and 7, the locking mechanism 30 contains two spring loaded locking pins 31, 32 which lock into apertures 34 of the sprocket disks 8, 9, respectively. If the sprocket disks 8, 9 are moved in the direction of the arrows 35 (see FIG. 7), the locking pins 31, 32 are moved towards each other against the force of a spring 33. The locking mechanism 30 is supported within the rocking lever 15.

In the slide element 4 is a stopping block 22, which by meshing with the margin perforations 10 in the feed strip 11 prevents any backward movement of the latter. In the illustrated application, the stopping block consists of a spring-loaded crossbar.

At the forward end of the slide element 4 is a limit stop 23 that is adjustable lengthwise to the slide element, and is lockable, for adapting the machine to different screw lengths.

In the guide frame 3 there is mounted an adjustable limit stop 24, against which the slide element 4 comes after finishing the screwing procedure, and by which the connection between the screwdriver 2 on one hand and the drive-shaft of the inserting tool on the other is released. By releasing the connection just after the slide element 4 has come up against the limit stop 24, the two halves of the coupling in the inserting tool 1 are conveyed into the release position, whereby the inserting procedure ends. The adjustment of the limit stop 24 is achieved with a set collar 25.

Figure 2:
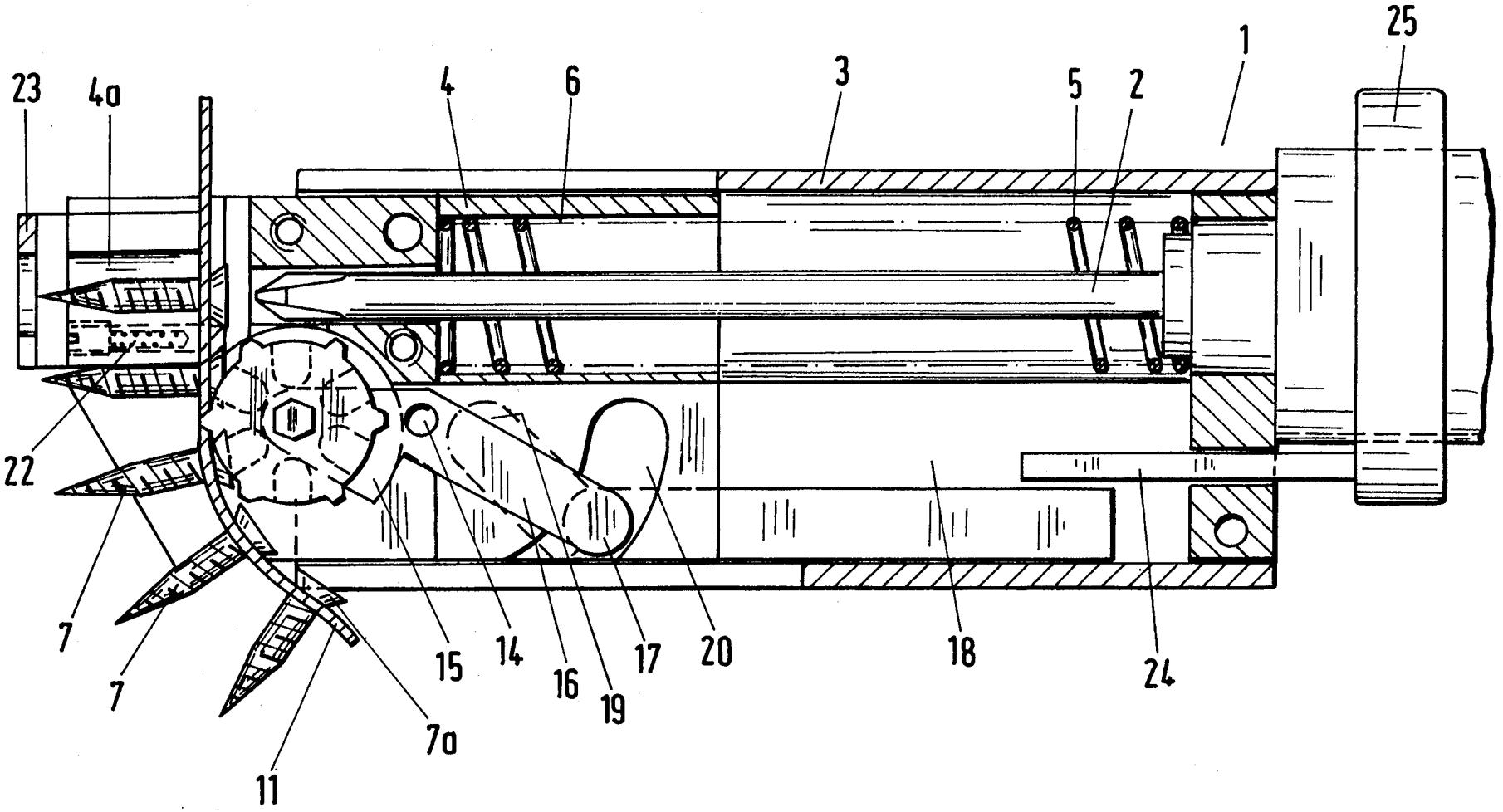
FIG. 2 a vertical cross-section of the inserting tool with feed strip set according to the invention in the insertion position.
Figure 3:
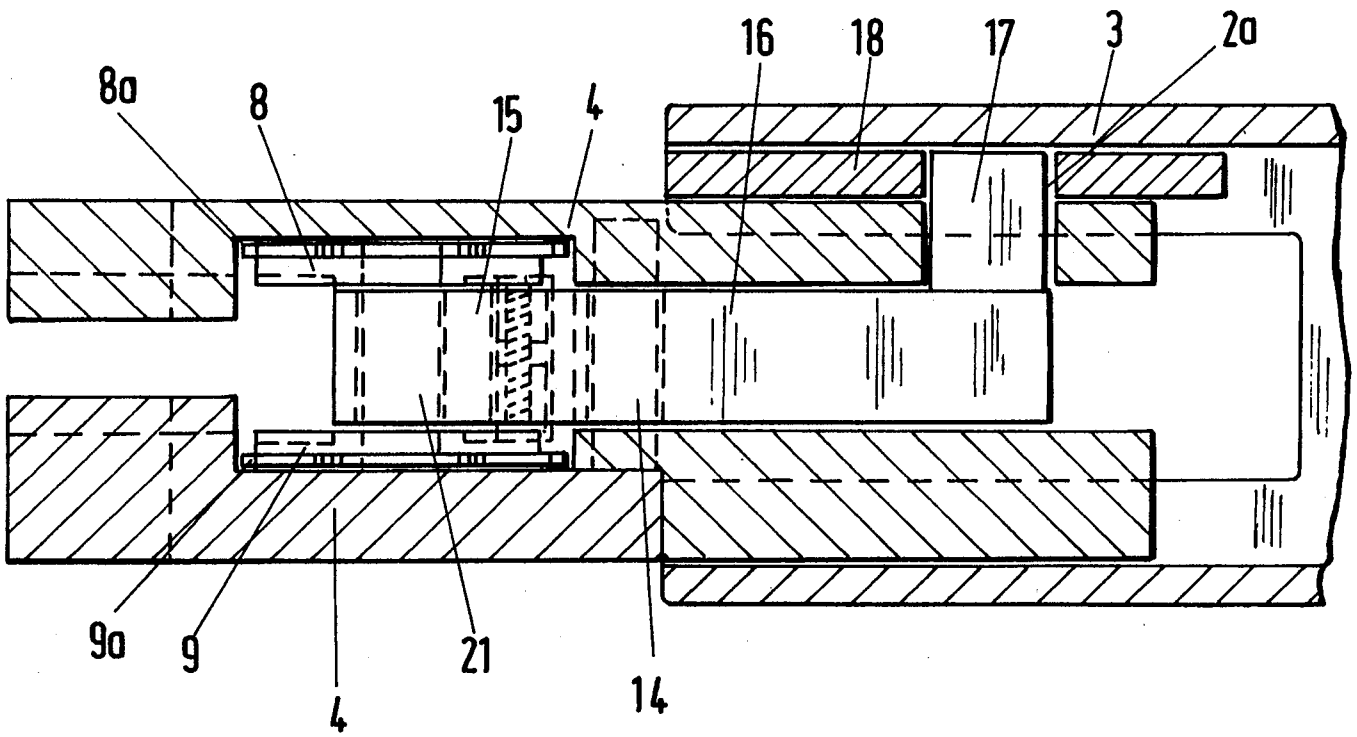
FIG. 3 a horizontal cross-section longitudinally along the line III—III in FIG. 1.
Figure 5:
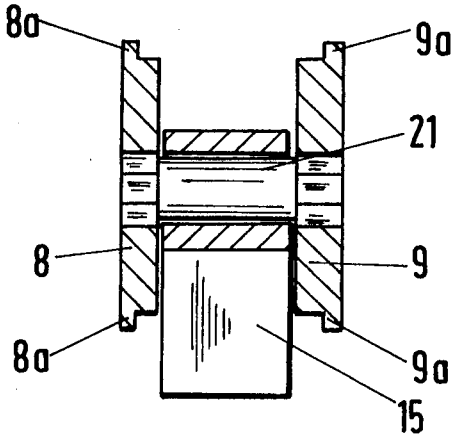
FIG. 5 shows a sectional view along the line V—V of FIG. 4, i.e. a section through an area of the part of FIG. 4 outside a locking mechanism.

The method of operation of the inserting tool is as follows:

To begin with, the feed strip 11, loaded with screws 7, is introduced into the slide element, as is shown clearly in FIG. 2 of the illustrations. In this way, the stopping block 22 engages the first margin perforation 10 at the forward end of the feed strip 11. The teeth 8*a*, 91 of the sprocket wheel thereupon engage the corresponding margin perforations 10 of the feed strip.

By pressing the limit stop 23 at the forward end of the slide element 4 against the workpiece (which for the sake of clarity is not shown in the illustration) the slide element 4 is forced to the right, in the illustration, against the bias of the spring 5. During this motion the control-pin 17 is moved along the oblique-running portion of the cam slot 19 in the plate 18, with the result that the rocking lever swings in a clockwise direction, and this causes the sprocket wheel to advance the screw-loaded feed strip by one step.

As the slide element 4 moves further against the bias of the spring 5, the corresponding screw 7 is inserted into the aperture 4*a* in the slide element 5, in which position it is aligned with the screwdriver. The screw 7 has now reached the screwing position. Immediately afterwards the control pin 17 moves into the longitudinal portion of the slot on the underside of the plate 18, so that the slide element 4 can also continue to move backwards against the bias of the spring 5, until the tip of the screwdriver 2 has reached the screw head 7*a*. Through the further movement of the slide element 4 in this direction, the coupling between the screwdriver and drive of the inserting tool 1 is engaged, so that the screwdriver 2 begins to turn. When the slide element 4 is moved a little further in the same direction, the screwdriver 2 engages the cross-slit in the screw head 7 and aligns the screw. The screw 7 is then forced through the corresponding perforation in the feed strip, by bending back the flanges 13, into the aperture of the slide element 4, and is screwed into the workpiece.

When the inserting tool 1 with the slide element 4 is retracted from the workpiece, the spring 5 forces the slide element 4 back into starting position (FIG. 1).

The control pin 17 then moves into the portion of the cam groove in the plate 18 that runs obliquely to the longitudinal direction of the guide frame 3, so that the rocking lever swings counter-clockwise. By this action the teeth 8*a*, 9*a* of the sprocket wheel engage the next margin perforations 10 of the feed strip 11. Any backward sliding of the strip against its direction of advancement is prevented by the stopping block 22. At this point the next advancing and screwing procedure begins.

What is claimed is:

1. Feeding device for an inserting tool for supplying fasteners, particularly screws, that are secured at fixed intervals from each other on a feed strip, comprising:

an elongate guide frame affixed to an inserting tool, in which frame a plate is arranged with a cam slot to guide a control element, in a form of a control pin, which operates a stepping mechanism;

the cam slot having a portion that runs obliquely to a longitudinal direction of the guide frame;

a lengthwise moveable slide element within this guide frame, which slides, against bias of a spring, in motion contrary to a direction in which the fasteners are to be inserted, which slide element has an ejection channel for a tool bit, and has a feed-in channel for the feed strip that opens laterally into this ejection channel, and which houses the stepping mechanism designed with a feed control in a form of rotatable sprocket wheel means;

the rotatable sprocket wheel means having teeth engage perforations in a margin of the feed strip;

a rocking lever being mounted in the slide element, the sprocket wheel means being rotationally mounted at the feed strip and of the rocking lever, whereas at the other end the control pin is mounted; and wherein the rocking lever is designed as a two-armed lever, and has stop means for stopping the sprocket wheel means from movement during advancing of the feed strip into the insertion position of the screw.

2. Device according to claim 1, wherein the sprocket wheel comprises two sprocket disks lying at a distance from each other, that are connected to each other by a spindle.

3. Device according to claim 1, wherein a stopping block is provided in the slide element, which by engaging the perforations of the margin in the feed strip prevents any backward movement of the feed strip.

4. Device according to claim 3, wherein at a forward end of the slide element a stop member is provided that is adjustable lengthwise to the slide element and lockable, for adapting to different lengths of screws.

5. Device according to claim 1, wherein the perforations are disposed on one side margin of the feed strip so that the teeth of the sprocket wheel means engage with one side margin of the feed strip.

6. Device according to claim 1, wherein the perforations are disposed on both side margins of the feed strip so that the teeth of the sprocket wheel means engage with both side margins of the feed strip.

* * * * *